United States Patent [19]

Jackson et al.

[11] 4,085,518

[45] Apr. 25, 1978

[54] DRYING OF WATER-WET SOLID MATERIALS

[75] Inventors: Harold L. Jackson, Hockessin, Del.; Frederick W. Mader, Kennett Square, Pa.

[73] Assignee: E. I. Du Pont de Nemours and Company, Wilmington, Del.

[21] Appl. No.: 721,441

[22] Filed: Sep. 8, 1976

[51] Int. Cl.[2] ..... F26B 5/00

[52] U.S. Cl. ..... 34/37; 34/77; 34/104

[58] Field of Search ..... 34/104, 105, 106, 15, 34/36, 37, 77, 92; 8/DIG. 94, DIG. 94 A

[56] References Cited

U.S. PATENT DOCUMENTS

| | | | |
|---|---|---|---|
| 2,871,574 | 2/1959 | Thies | 34/104 |
| 3,236,073 | 2/1966 | Davidson et al. | 34/77 |
| 3,962,798 | 6/1976 | Jackson | 34/9 |
| 3,998,588 | 12/1976 | Coraor et al. | 165/1 |

*Primary Examiner*—John J. Camby
*Assistant Examiner*—Larry I. Schwartz

[57] ABSTRACT

Process of drying water-wet solid materials, which process comprises, in a system, a. forcibly contacting the water-wet solid material with circulating vapor of a fluorocarbon having a fluorine to carbon atom ratio of at least 1.0 and a boiling temperature of less than about 80° C at atmospheric pressure, said fluorocarbon vapor being at a temperture above about 100° C and said contacting being carried out in the absence of a substantial amount of a noncondensable gas, such as air or nitrogen, b. passing the resulting mixture of fluorocarbon vapor and water vapor from step (a) through a zone maintained at a temperature less than 100° and at least 1° C above the atmospheric pressure boiling temperature of the fluorocarbon to condense a substantial portion of the water vapor but not a substantial portion of the fluorocarbon vapor and, preferably, so that the partial pressure of the water in the remaining vapor mixture is less than about 25 cm of mercury, c. heating the vapor mixture from step (b) to a temperature above about 100° C and recycling the mixture to step (a), d. repeating steps (a), (b) and (c), while maintaining substantially constant in the system the amount of fluorocarbon vapor, until the solid material is substantially free of water and contains only fluorocarbon vapor on its surfaces and/or occluded in its interstices, and thereafter e. removing and recovering from the solid material the fluorocarbon vapor values and f. recovering solid material which is substantially free of water and fluorocarbon.

9 Claims, 1 Drawing Figure

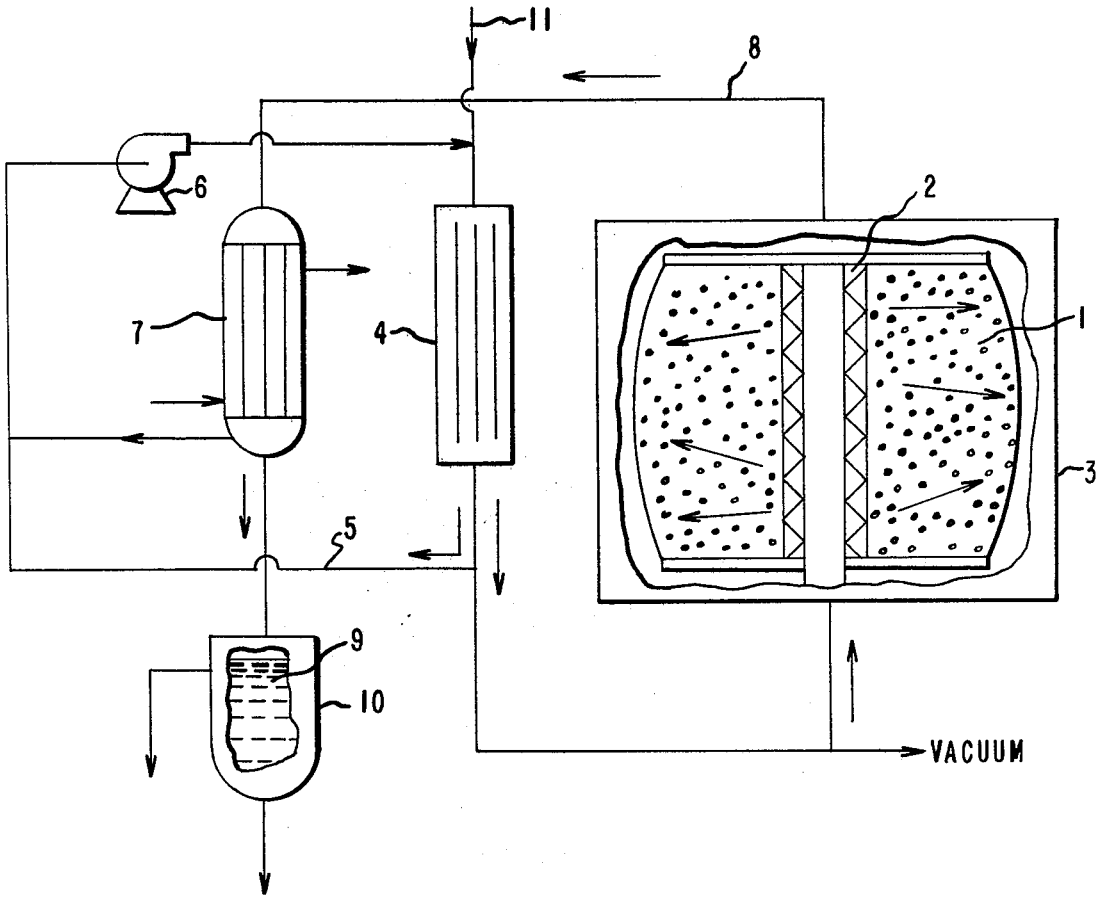
11
8
6
2
7
4
1
3
5
9
10
VACUUM

DRYING OF WATER-WET SOLID MATERIALS

SUMMARY OF THE INVENTION

In summary, the invention resides in a process of drying water-wet solid materials, which process comprises, in a system, a. forcibly contacting the water-wet solid material with circulating vapor of a fluorocarbon having a fluorine to carbon atom ratio of at least 1.0 and a boiling temperature of less than about 80° C at atmospheric pressure, said fluorocarbon vapor being at a temperature above about 100° C and said contacting being carried out in the absence of a substantial amount of a noncondensable gas, such as air or nitrogen, b. passing the resulting mixture of fluorocarbon vapor and water vapor from step (a) through a zone maintained at a temperature less than 100° and at least 1° C above the atmospheric pressure boiling temperature of the fluorocarbon to condense a substantial portion of the water vapor but not a substantial portion of the fluorocarbon vapor and, preferably, so that the partial pressure of the water in the remaining vapor mixture is less than about 25 cm of mercury, c. heating the vapor mixture from step (b) to a temperature above about 100° C and recycling the mixture to step (a), d. repeating steps (a), (b) and (c), while maintaining substantially constant in the system the amount of fluorocarbon vapor, until the solid material is substantially free of water and contains only fluorocarbon vapor on its surfaces and/or occluded in its interstices, and thereafter e. removing and recovering from the solid material the fluorocarbon vapor values and f. recovering solid material which is substantially free of water and fluorocarbon.

BACKGROUND OF THE INVENTION

1. Field of the Invention

This invention relates to the drying of water-wet solid materials.

2. Description of the Prior Art

Conventional methods of drying water-wet solid materials with hot air consume large amounts of energy because of the high specific heat and latent heat of vaporization of water and the poor heat transfer properties of air. Moreover, in hot air drying special measures must be taken to prevent oxidation of the material being dried. The use of gases other than air, including superheated vapors of organic compounds, for drying materials is well known. For example, U.S. Pat. No. 3,564,723 discloses the use of recycled superheated vapor, particularly steam, for drying water-wet particulate matter. Moisture is removed by bleeding off a portion of the superheated vapor. Preferably, a mixture of steam and an inert gas, such as nitrogen, is employed. U.S. Pat. No. 3,658,575 discloses drying of flexible substrates, including textile yarns, wet with an aqueous emulsion of a halogenated hydrocarbon by introducing the wet substrate into a zone filled with superheated vapors of a halogenated hydrocarbon, such as 1,1,2-trichloro-1,2,2-trifluoroethane. The halogenated hydrocarbon and water are removed. U.S. Pat. No. 3,998,588 discloses drying of water-wet textile bands by contacting the band with superheated vapor of a water-immiscible liquid which may be 1,1,2-trichloro-1,2,2-trifluoroethane or trichlorofluoromethane. U.S. Pat. No. 3,962,798 discloses drying water-wet porous materials by forced flow of a displacement liquid comprising a water-immiscible, normally liquid organic solvent, for example, 1,1,2-trichloro-1,2,2-trifluoroethan, having a surface-active agent dissolved therein through the interstices of the material, optionally followed by use of superheated vapor of the water-immiscible, normally liquid organic solvent.

BRIEF DESCRIPTION OF THE DRAWING

The FIGURE illustrates a batch process embodiment for drying a water-wet textile yarn package.

DETAILED DESCRIPTION OF THE INVENTION

This invention is directed to an energy-saving process for drying a water-wet solid material. By water-wet is meant that the material contains water to an extent of at least about 5% based on the weight of the dry material. Such water includes absorbed, adsorbed and occluded water. Consistent therewith, the water may be present as liquid water on the surfaces of the material (adsorbed water) or the water may be within the material (absorbed water). The invention process is not intended to remove water of crystallization or compounded water, for example, chemically produced water, such as from an alcohol in the formation of an olefin or an ether. By means of the process of this invention, water-wet substrates can be dried to a degree acceptable in the trade with minimum energy expenditures and with avoidance of environmental pollution. More specifically the process comprises, in a system, a. forcibly contacting the water-wet solid material with circulating vapor of a fluorocarbon having a fluorine to carbon atom ratio of at least 1.0 and a boiling temperature of less than about 80° C at atmospheric pressure, said fluorocarbon vapor being at a temperature above about 100° C and said contacting being carried out in the absence of a substantial amount of a noncondensable gas, such as air or nitrogen, b. passing the resulting mixture of fluorocarbon vapor and water vapor from step (a) through a zone maintained at a temperature less than 100° and at least 1° C above the atmospheric pressure boiling temperature of the fluorocarbon to condense a substantial portion of the water vapor but not a substantial portion of the fluorocarbon vapor and, preferably, so that the partial pressure of the water in the remaining vapor mixture is less than about 25 cm of mercury, c. heating the vapor mixture from step (b) to a temperature above about 100° C and recycling the mixture to step (a), d. repeating steps (a), (b), and (c), while maintaining substantially constant in the system the amount of fluorocarbon vapor, until the solid material is substantially free of water and contains only fluorocarbon vapor on its surfaces and/or occluded in its interstices, and thereafter e. removing and recovering from the solid material the fluorocarbon vapor values and f. recovering solid material which is substantially free of water and fluorocarbon.

The fluorocarbon vapor values of step (e) can be removed and recovered by subjecting the solid materials to a reduced pressure and thereafter subjecting the removed fluorocarbon vapor values to conventional condensation or absorption means. Alternatively, the fluorocarbon vapor on the solid material can be displaced with dry steam which is at a temperature sufficiently high to avoid condensation of the steam on the solid material, to produce a mixture of fluorocarbon vapor and steam, which mixture can then be cooled to produce a fluorocarbon liquid and/or gaseous phase and a water liquid phase. The fluorocarbon and water are separated, the fluorocarbon is recovered and the solid material, which is substantially free of water and fluorocarbon, also is recovered.

As already suggested, the invention relates to the processing of solid materials which are wet with water which must be removed therefrom to yield a useful product. Such solid materials include textile products, for example, natural and synthetic fibers, yarns, which may be in package form, webs and woven, nonwoven and knitted fabrics. The solid materials may have become wet during processing. Other solid materials from which processing water can be removed by this invention include rods, filaments, films or shaped articles. The solid materials may be comprised of conventional textile polymeric materials. Other useful polymeric materials include polyethylene, polypropylene, polystyrene, polyvinyl chloride and ureaformaldehyde and other synthetic plastics and resins. Still other solid materials which can be dried by the invention process include shaped metal and ceramic objects and products of natural origin, such as minerals, ores, wood and hair. The invention process has particular utility in the processing of textiles, for example, in the removal of water after the application of dyes and/or textile finishes or after aqueous scouring. It is to be understood, however, that the invention is not intended to be limited to this particular utility since it is broadly applicable to a wide variety of water-wet solid materials.

Critical to the invention process are a fluorocarbon carbon vapor recycle-drying step and a fluorocarbon vapor recovery step. In the drying step, the solid material, wet with water, is forcibly contacted with the vapor of the fluorocarbon by recycling the vapor around a loop which includes, in addition to the wet solid material, a superheater, a pump, a water vapor condensing zone maintained at a temperature less than 100° but at least 1° C above the atmospheric pressure boiling temperature of the fluorocarbon. The contacting of the wet solid material with the fluorocarbon vapor is carried out with the vapor temperature being above, preferably at least 5° C above, most preferably at least 25° C above, the boiling temperature of water, that is, 100° C at atmospheric pressure, and in the absence of a substantial amount of a permanent or noncondensable gas, such as air or nitrogen. Should air or other noncondensable gas be present, recovery efficiency of the fluorocarbon is reduced. As the term is used herein, a noncondensable gas is one whose atmospheric pressure boiling point is below −78° C (carbon dioxide boiling point).

Fluorocarbons which are suitable herein must have a fluorine to carbon atom ratio of at least 1.0 and they must be immiscible with water. Since the fluorocarbon must not be condensed in the water vapor condensing zone (with the water which is removed from the substrate), its boiling point must be less than that of water. For example, at a process pressure of one atmosphere the fluorocarbon should have a boiling point less than about 100° C., preferably less than about 80° C. Also, for energy conservation, the fluorocarbon should possess a latent heat of vaporization at its boiling temperature of below about 100 cal/gram, preferably below about 50 cal/gram. Suitable fluorocarbons meeting the above criteria include saturated fluoro- and chlorofluoro substituted aliphatic and cycloaliphatic hydrocarbons. Fluorine-containing compounds are preferred because of their nonflammability and their greater inertness to and insolubility in polymers and fiber materials, their low toxicity, boiling point, specific heat and latent heat of vaporization and their rapid and efficient separability from water. Fluoro- and chlorofluoro substituted aliphatic hydrocarbons which provide suitable vapor for the invention process include chlorofluoromethanes, such as trichlorofluoromethane, dichlorofluoromethane and chlorofluoromethane; chlorofluoroethanes, such as 1,1,2-trichloro-1,2,2-trifluoroethane, 1,2-dichloro-1,2-difluoroethane, 1,1-dichloro-2,2-difluoroethane, 1,1dichloro-1,2,2-trifluoroethane, 1-chloro-2,2,2-trifluoroethane, 1,1,1,2-tetrafluoroethane, 1-chloro-1,2,2,2,-tetrafluoroethane and 1,1-dichloro-2,2,2-trifluoroethane; fluoro- and chlorofluoro propanes, such as perfluoropropane, 2,2-dichloro-1,1,1,3,3,3-hexafluoropropane, 1,2-dichloro-1,1,2,3,3,3-hexafluoropropane and 1,1,1-trichloro-2,2,3,3,3-pentafluoropropane; and fluoro- and chlorofluoro butanes, such as perfluorobutane, 1,2-dichlorohexafluorobutane and 2,2-dichlorohexafluorobutane. Useful fluoro- and chlorofluoro cycloaliphatic hydrocarbons include perfluorocyclobutane, perfluoro(dimethylcyclobutane) and 1,2-dichlorohexafluorocyclobutane. The chlorofluoromethanes and chlorofluoroethanes are preferred. Of the chlorofluoromethanes, trichlorofluoromethane and dichlorodifluoromethane are preferred. Of the chlorofluoroethanes, 1,1,2-trichloro-1,2,2-trifluoroethane and 1,1-dichloro-2,2,2-trifluoroethane are preferred. Most prefered is 1,1,2-trichloro-1,2,2-trifluoroethane.

In the vapor recovery step of the invention process, the residual vapor values from the fluorocarbon used are removed from the dried solid material, that is, solid material which is substantially free of water, by displacement with dry steam which is at a temperature sufficiently high to prevent substantial condensation thereof on the solid material. Moreover, the temperature of the solid material must be above the boiling point of water at the prevailing pressure so that the sensible heat of the solid material will prevent condensation as the dry steam, that is, steam which is free of liquid water, displaces the fluorocarbon vapor values. The mixture of fluorocarbon vapor and steam is passed into a condensing zone to form a fluorocarbon liquid and/or gaseous phase and a water liquid phase, after which the fluorocarbon is separated, recovered and returned for reuse.

Alternatively, the fluorocarbon residual vapor values can be removed from the solid material and recovered by employing vacuum means in conjunction with conventional condensation and/or absorption means, for example, absorption on activated carbon. The fluorocarbon can be collected in an appropriate storage container until required for reuse in the recycle-drying step.

In preferred embodiments of the invention, the vapor of the fluorocarbon is recycled around a loop which includes a superheater, a pump, the solid material and a condenser providing a water vapor condensing zone at a temperature above the boiling point of the fluorocarbon but below the boiling point of water at the prevailing pressure. Water is removed from the solid material by displacement by the forcible contact of the fluorocarbon vapor with the solid material and by vaporization by sensible heat supplied by the superheat of the fluorocarbon vapor. The mixture of displaced liquid water, water vapor and fluorocarbon vapor passes through the condensing zone wherein the water vapor condenses. This liquid water condensate and the displaced liquid water pass to a water collector, from which it is normally discarded. The fluorocarbon vapor passes to the pump, thence to the superheater and again to the solid material.

The energy investment in this process consists of, at steady state, only the energy needed to superheat fluorocarbon vapor to a degree corresponding to the heat of vaporization of the water wetting the solid material and the energy needed to provide either the superheated steam or the vacuum to remove the fluorocarbon vapors from the solid material.

In amplification of the previous description, the FIGURE herein illustrates a batch embodiment of the invention process, namely, the drying of a textile yarn package which is wet with water, for example, after dyeing. A yarn package 1 wound on a compressible spring core 2 is mounted, preferably somewhat compressed, in the art-customary manner on a hollow spindle (not shown) in kier 3. Although the FIGURE shows a single package being dried, it is to be understood that a plurality of packages on a plurality of hollow spindles within the same kier can be dried by employing obvious modifications. In the first step, vapor of the fluorocarbon enters at line 11 through a valve (not shown) which is arranged to direct the vapor into superheater 4. The superheated vapor is directed into bypass 5, thence to pump 6 and is recycled through this bypass system. Air is removed from kier 3, condenser 7 and associated piping by vacuum. The bypass line 5 is closed and heated fluorocarbon vapor is directed into hollow spindle (not shown), thence through the holes therein, through spring core 2 and thereafter through the interstitial spaces of the yarn package 1. Heat may be provided to the kier to prevent the initial fluorocarbon vapor entering the kier from condensing. A mixture of fluorocarbon vapor, water vapor and liquid water and, later, after all surface water is removed, a mixture of fluorocarbon vapor and water vapor leaves kier 3 via line 8. This mixture enters condenser 7, maintained at a temperature less than 100° and at least 1° C above the boiling temperature of the fluorocarbon, wherein a substantial portion of the water vapor condenses. The water condensate 9 and the liquid surface water 9 pass to a water collector 10 and are discarded. The fluorocarbon vapor is not condensed. This vapor stream is recycled by means of pump 6 to superheater 4 and package 1. The superheated vapor is recycled in this manner at a temperature and for a time sufficient to evaporate substantially all of the water in the yarn package. Alternatively, particularly when there are large amounts of liquid water entering line 8, a surge tank (not shown) is provided to remove substantially all of the liquid water so that only water vapor and fluorocarbon vapor enter condenser 7. In the fluorocarbon vapor recovery step of the invention, dry steam is admitted to the package, now at a temperature above 100° C, at line 11 via the superheater 4, and pump 6 is shut off to prevent steam recycle. Dry steam is passed through the package 1 for a time and at a temperature such that substantially all of the fluorocarbon vapors in the package, the kier 3 and associated equipment are displaced and no substantial amount of steam condenses in the package. Thereafter, the steam is shut off and the substantially dry package is recovered from kier 3. The mixture of steam and the fluorocarbon vapor from the package and the kier are directed into condenser 7 wherein the steam condenses; the fluorocarbon is separated and recovered for reuse by conventional means. Water, from the condensed steam, generally is discarded.

The superheated vapor and the steam also can be circulated in the other direction through the package, that is, from the outside to the inside. Generally, to insure uniformity of dryness of the package, it is desirable to alternate the fluorocarbon vapor flow direction; for example, the superheated fluorocarbon vapor first is passed through the package from inside to outside until 80–90% of the water is removed and then the flow is reversed to an outside-to-inside direction until the package is dry. By obvious modifications, a plurality of packages can be dried at the same time.

The process described above is especially useful for drying yarn packages which have been subjected to acqueous scouring, bleaching and/or dyeing.

The invention is further illustrated by the following examples:

EXAMPLE 1

Six packages of 20/1 rayon yarn (which had been stored under ambient conditions) were saturated with water, mounted on a spindle and positioned in an apparatus similar to that shown in the FIGURE. The yarn had been dyed to a solid shade (violet) with a mixture of commercially available direct dyes and rinsed. Each package contained 1.2 kg (dry weight) of yarn wound on a dye tube 17 cm long and 2.6 cm in diameter. Water content was about 200% of the dry yarn weight. The kier was evacuated to about 25.3 cm of mercury for 5 minutes. In addition to removing air, this evacuation reduced the water content of the yarn packages to about 150%, based on the weight of dry yarn. Vapor of 1,1,2-trichloro-1,2,2-trifluoroethane superheated to about 150° C was passed through the packages in an inside-to-outside direction. Following an initial period of about 1 minute, during which liquid water from the yarn package interstices was forced out and the temperature of the package was elevated to 48° C, the flow of the recycling vapor was maintained at a rate of 40.9–45.4 kg/minute, with 1,1,2-trichloro-1,2,2-trifluoroethane being added as necessary to maintain this rate. After 19 minutes the vapor temperature at the kier was about 140° C and vapor flow was stopped. The kier was evacuated to about 38 cm of mercury for 0.5 minute, with the effluent vapors being condensed and recovered for reuse by conventional means. The dry packages were removed, the weights therof being at an average of about 4.5% less than their weights at the ambient storage conditions. In contrast to conventional hot air drying procedures for rayon yarn packages which require 6–10 hours to achieve this same degree of dryness, this invention process required less than 25 minutes.

In another experiment six packages of the same rayon yarn were dried by the much more complex process of U.S. Pat. No. 3,962,798 whereby a displacement liquid consisting of 1,1,2-trichloro-1,2,2-trifluoroethane containing a surface active agent was forced through the interstices of the wet packages, followed by the superheated vapor of 1,1,2-trichloro-1,2,2-trifluoroethane. Although the time and degree of drying were substantially the same, the process (and equipment required) and the economic feasibility of operating the process (and providing the equipment) were much less favorable than with the invention process (and equipment).

EXAMPLE 2

This example demonstrates the more rapid drying of packages of cotton yarn by the invention process than with conventional processes employing hot air at atmospheric pressure. Six packages of 10/1 cotton yarn wound on dye tubes were dried with vapor of 1,1,2-trichloro-1,2,2-trifluoroethane superheated to 150° C by a procedure similar to that disclosed in Example 1. By this process the packages, total dry weight of 7.1 kg, were dried, from an initial water content of 280%, to 0.5%, based on the weight of the dry yarn, in 33 minutes.

The experiment was repeated with air at 150° C in place of the 1,1,2-trichloro-1,2,2-trifluoroethane vapor. After 120 minutes the packages still contained about 25% water, based on the weight of the dry yarn. Extrapolation of such a drying rate shows that a total of at least 240 minutes would be necessary to reach the dryness level achieved by the invention process in 30 minutes.

EXAMPLES 3–8

These examples demonstrate that 1,1,2-trichloro-1,2,2-trifluoroethane, 1,1-dichloro-2,2,2-trifluoroethane and trichlorofluoromethane are equally effective as superheated vapors for drying yarn packages by the invention process. In these examples the wet package of yarn on a spring core was placed between flat end plates on a perforated spindle, compressed to about 70% of its original height and mounted in a kier in a manner such as shown in the FIGURE. The fluorocarbon vapor was passed through the package in an inside-to-outside direction. The effluent water, water vapor and fluorocarbon vapor passed to a water-cooled condenser. Fluorocarbon vapor flow was stopped when water condensate ceased to collect. The yarn package was weighed and in each example was less than its original weight under ambient conditions. Although the fluorocarbon vapor was not recycled and the fluorocarbon vapor values were not recovered in Examples 3–8, it is to be understood that such steps would be included when carrying out the invention process. Data for Examples 3–8 appear in the following table:

| | | Yarn Package | | | Vapor | | Time to |
|---|---|---|---|---|---|---|---|
| | | | Weight (g) | | Temp | Flow | Dryness |
| Example | Fluorocarbon | Type | Dry | Wet | (° C) | kg/min | (min) |
| 3 | $CHCl_2CF_3$ | Cotton, 8/1 | 358 | 1278 | 140 | 1.2 | 25 |
| 4 | $CHCl_2CF_3$ | Polyester, text. 150 den | 340 | 1044 | 140 | 1.3 | 12 |
| 5 | $CFCl_3$ | Cotton, 8/1 | 367 | 1242 | 140 | 1.4 | 24 |
| 6 | $CFCl_3$ | Polyester, text. 150 den | 361 | 1089 | 140 | 1.4 | 12 |
| 7 | $CFCl_2CF_2Cl$ | Cotton, 8/1 | 382 | 1138 | 140 | 1.4 | 25 |
| 8 | $CFCl_2CF_2Cl$ | Polyester, text. 150 den | 336 | 1125 | 140 | 1.4 | 13 |

We claim:

1. Process of drying water-wet solid materials, which process comprises, in a system,
   a. forcibly contacting the water-wet solid material with circulating vapor of a fluorocarbon having a fluorine to carbon atom ratio of at least 1.0 and a boiling temperature of less than about 80° C at atmospheric pressure, said fluorocarbon vapor being at a temperature above about 100° C and said contacting being carried out in the absence of a substantial amount of a noncondensable gas,
   b. passing the resulting mixture of fluorocarbon vapor and water vapor from step (a) through a zone maintained at a temperature less than 100° and at least 1° C above the atmospheric pressure boiling temperature of the fluorocarbon to condense a substantial portion of the water vapor but not a substantial portion of the fluorocarbon vapor,
   c. heating the vapor mixture from step (b) to a temperature above about 100° C and recycling the mixture to step (a),
   d. repeating steps (a), (b) and (c), while maintaining substantially constant in the system the amount of fluorocarbon vapor, until the solid material is substantially free of water and contains only fluorocarbon vapor on its surfaces and/or occluded in its interstices, and thereafter.
   e. removing and recovering from the solid material the fluorocarbon vapor values and
   f. recovering solid material which is substantially free of water and fluorocarbon.

2. Process of claim 1 wherein the fluorocarbon vapor values of step (e) are removed and recovered by subjecting the solid material to a reduced pressure and thereafter subjecting the removed fluorocarbon vapor values to condensation means.

3. Process of claim 1 wherein the fluorocarbon vapor values of step (e) are removed and recovered by subjecting the solid material to a reduced pressure and thereafter subjecting the removed fluorocarbon vapor values to absorption means.

4. Process of claim 1 wherein the fluorocarbon vapor values of step (e) are removed and recovered by displacing the fluorocarbon vapor on the solid material with dry steam which is at a temperature sufficiently high to avoid condensation of the steam on the solid material, to produce a mixture of fluorocarbon vapor and steam, and thereafter cooling the mixture to produce a water liquid phase and a fluorocarbon liquid and/or gaseous phase, separating the water and the fluorocarbon, and recovering the fluorocarbon.

5. Process of claim 1 wherein the fluorocarbon is 1,1,2-trichloro-1,2,2-trifluoroethane.

6. Process of claim 1 wherein the fluorocarbon is 1,1-dichloro-2,2,2-trifluoroethane.

7. Process of claim 1 wherein the fluorocarbon is dichlorodifluoromethane.

8. Process of claim 1 wherein the fluorocarbon is trichlorofluoromethane.

9. Process of claim 1 wherein the partial pressure of the water in the remaining vapor mixture from step (b) is less than about 25 cm of mercury.

* * * * *